US010114403B2

(12) United States Patent
Kadoi

(10) Patent No.: US 10,114,403 B2
(45) Date of Patent: Oct. 30, 2018

(54) VEHICLE PEDAL DEVICE

(71) Applicant: TOYOTA JIDOSHA KABUSHIKI KAISHA, Toyota-shi (JP)

(72) Inventor: Hironori Kadoi, Toyota (JP)

(73) Assignee: TOYOTA JIDOSHA KABUSHIKI, Toyota-shi (JP)

( * ) Notice: Subject to any disclaimer, the term of this patent is extended or adjusted under 35 U.S.C. 154(b) by 27 days.

(21) Appl. No.: 15/266,900

(22) Filed: Sep. 15, 2016

(65) Prior Publication Data

US 2017/0090504 A1 Mar. 30, 2017

(30) Foreign Application Priority Data

Sep. 24, 2015 (JP) ..... 2015-187086

(51) Int. Cl.
*G05G 1/44* (2008.04)
*G05G 1/483* (2008.04)

(52) U.S. Cl.
CPC ..... *G05G 1/44* (2013.01); *G05G 1/483* (2013.01)

(58) Field of Classification Search
CPC ..... G05G 1/44; G05G 1/445; G05G 1/487; G05G 1/483; G05G 1/48; G05G 1/506; G05G 1/50; G05G 1/32; G05G 1/327; G05G 1/38; G05G 1/30; G05G 1/36; B60K 26/02; B60K 26/021; B60K 2026/026; B60K 2026/022–2026/023; Y10T 74/20528–74/2054; Y10T 74/20888–74/20906
See application file for complete search history.

(56) References Cited

U.S. PATENT DOCUMENTS

| | | | | |
|---|---|---|---|---|
| 7,703,351 | B2 * | 4/2010 | Sakuraba | B60K 26/02 74/513 |
| 8,794,102 | B2 * | 8/2014 | Heitkamp | G05G 1/44 180/271 |
| 2010/0263469 | A1 | 10/2010 | Ohtsubo et al. | |
| 2010/0319480 | A1 | 12/2010 | Nebuya et al. | |
| 2012/0132028 | A1 * | 5/2012 | Kim | G05G 1/405 74/512 |
| 2013/0233118 | A1 * | 9/2013 | Khan | G05G 1/44 74/514 |

FOREIGN PATENT DOCUMENTS

| | | | |
|---|---|---|---|
| JP | S59-024626 | U | 2/1984 |
| JP | 2003-312304 | A | 11/2003 |
| JP | 2009-292458 | A | 12/2009 |
| JP | 2010-247733 | | 11/2010 |
| JP | 2011-3086 | | 1/2011 |
| JP | 2012-116368 | A | 6/2012 |
| JP | 2012-118960 | | 6/2012 |
| JP | 2015-033925 | A | 2/2015 |

* cited by examiner

*Primary Examiner* — Daniel D Yabut
(74) *Attorney, Agent, or Firm* — Oblon, McClelland Maier & Neustadt, L.L.P.

(57) ABSTRACT

A vehicle pedal device includes a support unit fixed to a vehicle body. A hinge is supported by the support unit. A rectangular pad includes a lower longitudinal end pivotally supported by the hinge. An arm supported by the support unit follows pivoting of the pad. The pad includes a first restriction portion, and the support unit includes a second restriction portion. The first restriction portion and the second restriction portion cooperate with each other to restrict displacement of the pad in a lateral direction of the pad.

7 Claims, 8 Drawing Sheets

VEHICLE PEDAL DEVICE

BACKGROUND

The present disclosure relates to a vehicle pedal device.

Japanese Laid-Open Patent Publication No. 2011-3086 describes a vehicle pedal device including a pad, a hinge, and a base. The pad is depressed by a driver. The hinge is a thin plate arranged on the lower end of the pad. The base, which is fixed to the vehicle body, supports the hinge. The pad is pivotal about the hinge in the front-rear direction of the vehicle. An arm is connected to a rear surface of the pad. The arm follows the pivoting of the pad and moves in the front-rear direction of the vehicle. A biasing member constantly urges the arm in the rear direction of the vehicle to press the arm against the pad toward the rear of the vehicle. When the driver depresses the pad, the pad pivots toward the front of the vehicle against the biasing force of the biasing member. This moves the arm toward the front of the vehicle. When the driver releases the pad, the biasing force of the biasing member pivots the arm and moves the pad toward the rear of the vehicle. This returns the pad and the arm to a predetermined initial position. A throttle valve of an internal combustion engine is mechanically connected to the arm. Movement of the arm varies the open degree of the throttle valve.

When the driver depresses the pad, load may be applied to the pad in the lateral direction of the vehicle in addition to the front-rear direction of the vehicle. When a large load is applied to the pad in the lateral direction of the vehicle, excessive stress may be applied to the hinge that supports the pad. This may deteriorate the durability of the hinge.

SUMMARY

It is an object of the present disclosure that obviates the generation of excessive stress at the hinge.

To achieve the above object, the present disclosure provides a vehicle pedal device including a support unit fixed to a vehicle body. A hinge is supported by the support unit. A pad has the form of a rectangular plate. The pad includes a lower longitudinal end pivotally supported by the hinge. An arm supported by the support unit follows pivoting of the pad. The pad includes a first restriction portion. The support unit includes a second restriction portion. The first restriction portion and the second restriction portion cooperate with each other to restrict displacement of the pad in a lateral direction of the pad.

Other aspects and advantages of the present disclosure will become apparent from the following description, taken in conjunction with the accompanying drawings, illustrating by way of example the principles of the disclosure.

BRIEF DESCRIPTION OF THE DRAWINGS

The disclosure may be understood by reference to the following description together with the accompanying drawings.

DETAILED DESCRIPTION

One embodiment of a vehicle pedal device will now be described with reference to FIGS. 1 to 6. In the present embodiment, the vehicle pedal device is applied to an accelerator pedal of a vehicle. The vehicle of this example has a right-hand steering wheel, and the accelerator pedal is located at the right side of the vehicle.

Figure 1:
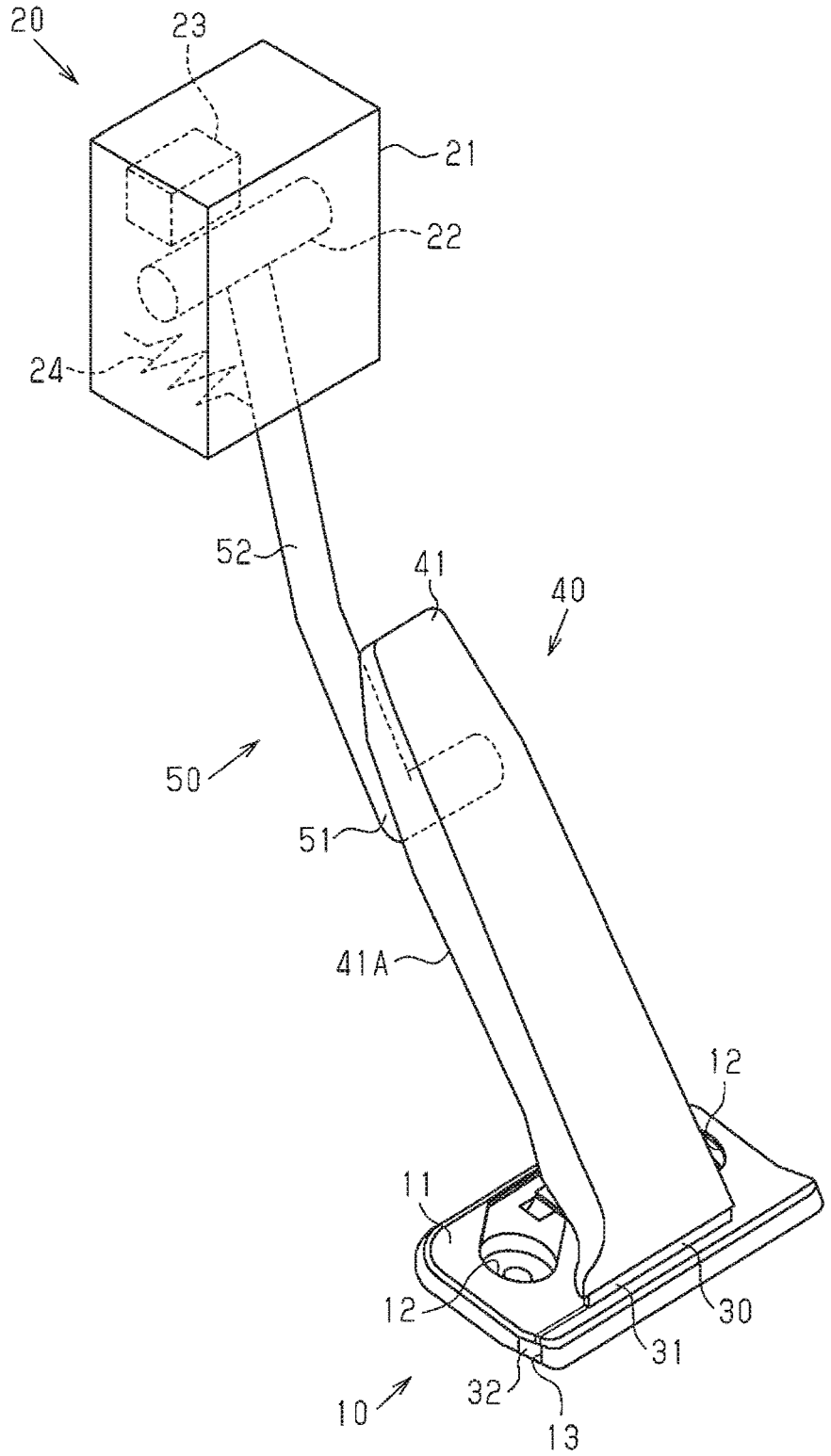
FIG. 1 is a perspective view of a vehicle pedal device.

Referring to FIG. 1, the vehicle pedal device includes a support unit fixed to the vehicle body. The support unit includes a base 10 and a housing 20. The base 10 supports a hinge 30, and a pad 40 extends from the upper end of the hinge 30. The housing 20 is located at a higher position than the pad 40. The housing 20 includes a box 21, and a pivot shaft 22 is arranged in the box 21 extending in the lateral direction of the pad 40. The pivot shaft 22 is rotationally supported by the box 21. A rotation angle sensor 23 is arranged in the box 21 to detect the rotation angle of the pivot shaft 22. An arm 50 connects the housing 20 and the pad 40. The arm 50 includes an insertion portion 51, which extends in the lateral direction of the pad 40, and a coupling portion 52, which upwardly extends from one end of the insertion portion 51. The upper part of the coupling portion 52 is accommodated in the housing 20, and the upper end of the coupling portion 52 is coupled to the circumferential surface of the pivot shaft 22. The arm 50 is pivotal about the pivot shaft 22. The insertion portion 51 of the arm 50 is coupled to the rear surface 41A of the pad 40. The housing 20 accommodates a spring 24 that pivots the arm 50 against the pad 40.

Figure 2:
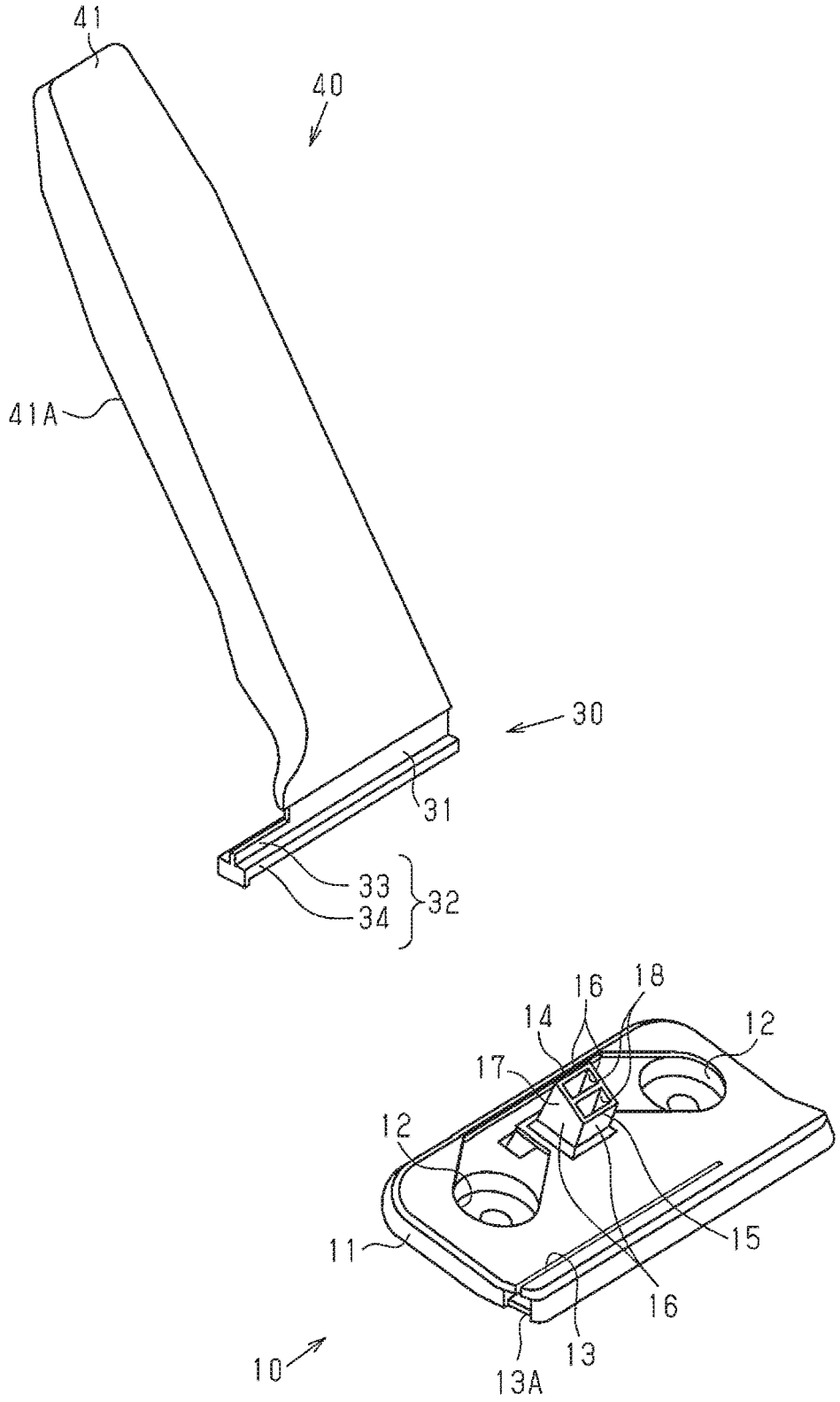
FIG. 2 is an exploded perspective view of a pad and a base.

As shown in FIG. 2, the pad 40 includes a rectangular depressing plate 41. The pad 40 is formed from, for example, plastic. The hinge 30, which is arranged on the lower end of the pad 40, includes a hinge portion 31 and an engagement portion 32. The hinge portion 31 is a thin plate extending in the lateral direction of the pad 40. The engagement portion 32 is arranged on the lower end of the hinge portion 31. The hinge 30 is formed from, for example, an elastic plastic. The pad 40 and the hinge 30 may be connected to each other by performing, for example, two-color molding in which the hinge 30 is first molded and then the pad 40 is integrally molded with the upper end of the hinge 30. The engagement portion 32 includes a connector 33 and a rest 34. The connector 33 downwardly extends from the hinge portion 31 and has an end extending beyond the hinge portion 31 in the lateral direction of the pad 40. The rest 34, which is thicker than the connector 33, downwardly extends from the connector 33 and supports the connector 33.

The base 10 includes a rectangular support plate 11. The base 10 is arranged so that the long sides of the base 10 extend in the lateral direction of the pad 40. The support plate 11 includes two bolt holes 12, which are spaced apart from each other in the longitudinal direction of the support plate 11. Further, the support plate 11 includes an engagement groove 13 that extends in the longitudinal direction of the support plate 11. The engagement groove 13 is located farther from the housing 20 than the bolt holes 12. The engagement groove 13 is shaped in conformance with the engagement portion 32 and includes an opening 13A in one side of the support plate 11. The engagement portion 32 is fitted into engagement groove 13 from the opening 13A and engaged with the engagement groove 13 to couple the hinge portion 31 to the base 10. The hinge portion 31 upwardly projects from the base 10. By coupling the hinge 30 to the base 10 in this manner, the lower end of the pad 40 is pivotally supported by the base 10.

Figure 3:
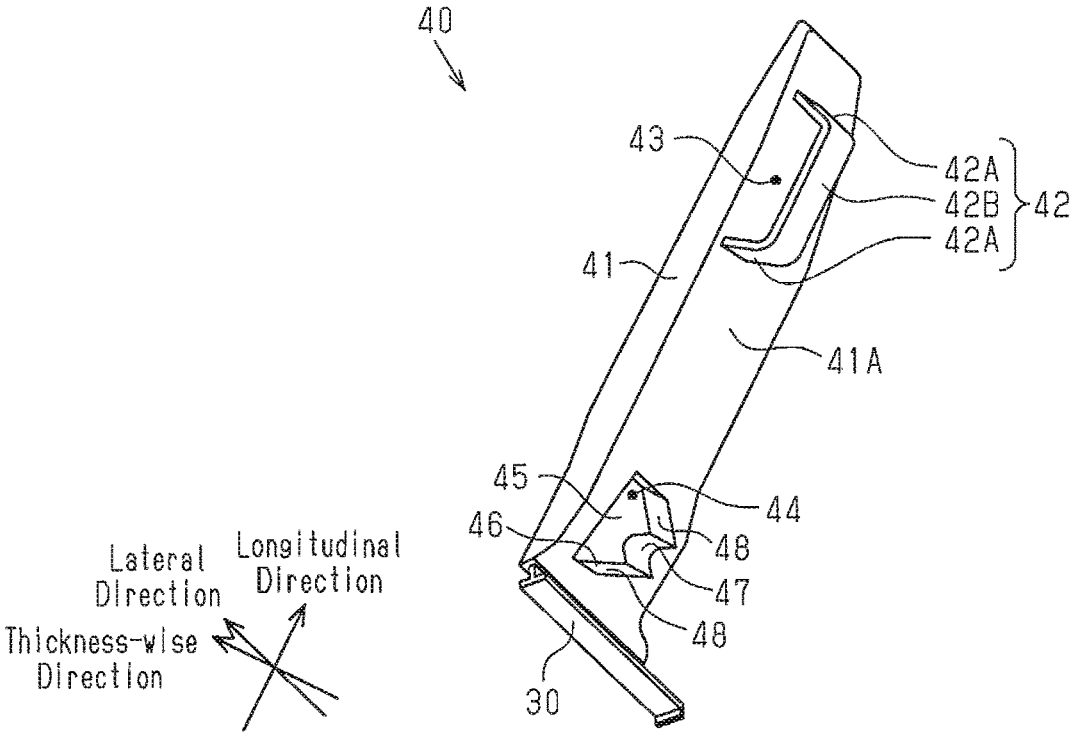
FIG. 3 is a perspective view showing the rear surface of the pad.

As shown in FIG. 3, the depressing plate 41 of the pad 40 includes a holding portion 42 defined on the rear surface 41A. The holding portion 42, which extends from the rear surface 41A in the thickness-wise direction of the pad 40, includes two opposing walls 42A that are opposed to each other in the longitudinal direction of the pad 40. The two opposing walls 42A each include a basal end that is fixed to the rear surface 41A of the depressing plate 41 and a distal end connected to the distal end of the other opposing wall 42A by a side wall 423. The opposing walls 42A and the side wall 423 define an elongated hole 43 that extends in the lateral direction of the pad 40. The insertion portion 51 of the arm 50 is inserted through the elongated hole 43 to couple the arm 50 to the pad 40 as shown in FIG. 1 so that the arm 50, which is supported by the housing 20, follows the pivoting of the pad 40.

As shown in FIG. 3, the rear surface 41A of the depressing plate 41 includes a socket 44 that is recessed in the thickness-wise direction of the pad 40 and serves as a first restriction portion. The socket 44 (recess) is located near the lower longitudinal end of the pad 40. The socket 44 includes a bottom wall 45 and a peripheral wall 46 extending from the bottom wall 45 in the thickness-wise direction of the pad 40. The peripheral wall 46 of the socket 44 includes a bulged portion 47 that is bulged toward the center of the socket 44. The bulged portion 47 extends from the peripheral wall 46 in a lateral direction of the pad 40. The bulged portion 47 extends continuously from the open end of the socket 44 to the bottom wall 45 of the socket 44. The bulged portion 47 narrows as the center of the socket 44 becomes closer. That is, the bulged portion 47 narrows toward its distal end. Thus, when viewed in the thickness-wise direction of the pad 40, the bulged portion 47 is shaped so that the cross-sectional area of the bulged portion 47 decreases toward its distal end. The peripheral wall 46 further includes two diagonal portions 48 located on opposite sides of the bulged portion 47. The diagonal portions 48 become closer to each other as the bulged portion 47 becomes closer.

As shown in FIG. 2, the support plate 11 of the base 10 includes a stopper 14 located between the bolt holes 12, which are separated from each other. The stopper 14 is a projection that upwardly projects from the upper surface of the support plate 11 and functions as a second restriction portion. The stopper 14, which is box-shaped, includes a main body 17 and cavities 18. The main body 17 includes an end surface 15 and a peripheral wall 16 that has four sides. The cavities 18 open in the end surface 15 of the main body 17. The end surface 15 of the main body 17 is sloped to approach the upper surface of the support plate 11 as the engagement groove 13 becomes closer.

Figure 4:
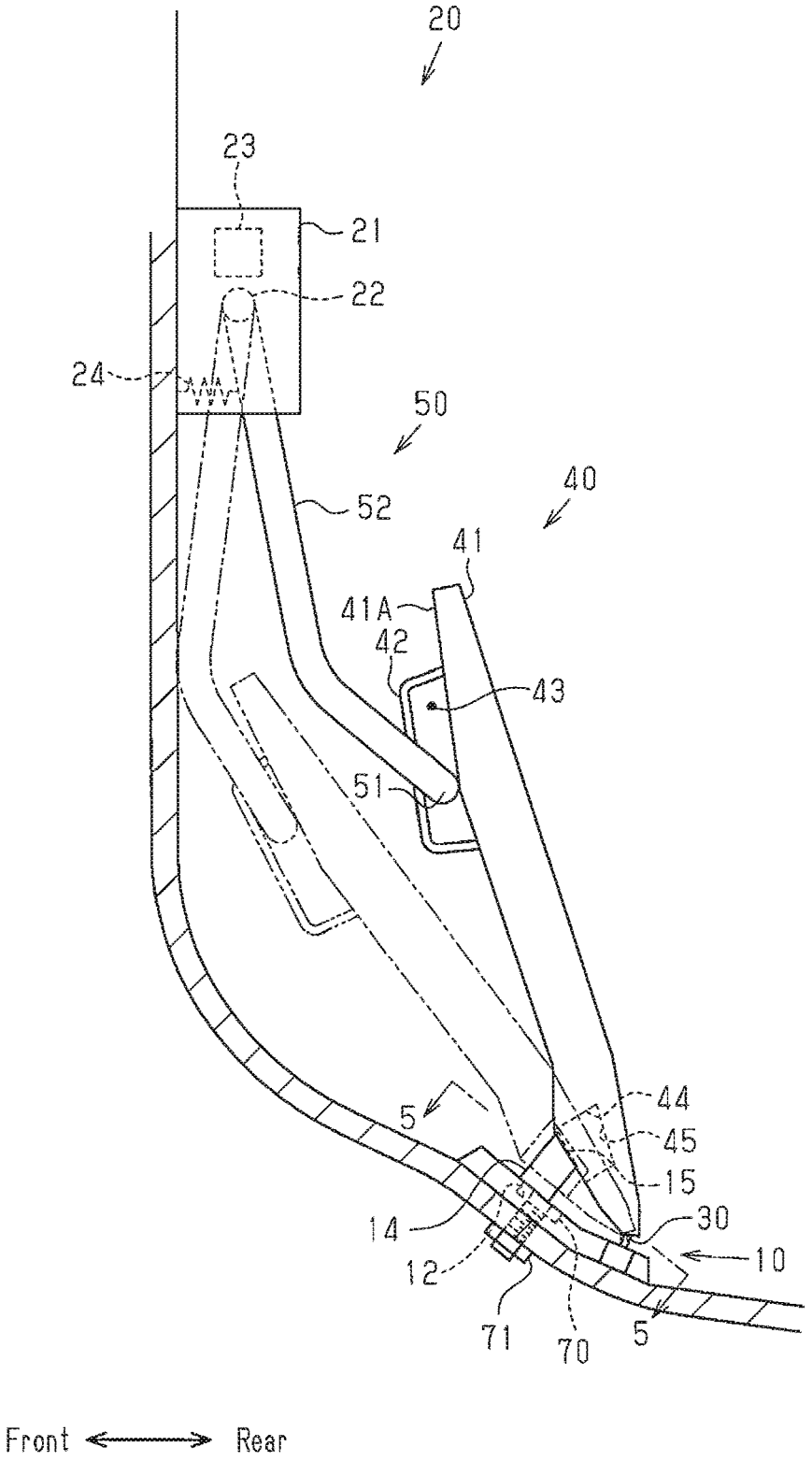
FIG. 4 is a side view of the vehicle pedal device.

FIG. 4 shows the vehicle pedal device coupled to the vehicle. In this state, bolts 70 are inserted through the bolt holes 70 of the base 10 and fastened to nuts 71 that are fixed to the vehicle body. The housing 20 is also fixed to the vehicle body using bolts and nut (not shown). The hinge 30 extends in the lateral direction of the pad 40, that is, the lateral direction of the vehicle. The pad 40 is arranged on the base 10 pivotally about the hinge 30 in the front-rear direction of the vehicle. When the pad 40 is not depressed by the driver, the spring 24 in the housing 20 biases the arm 50 and the pad 40 to a predetermined position that is located toward the rear of the vehicle (right side as viewed in FIG. 4). The predetermined position is an initial position where the pivot amount of the arm 50 and the pad 40 is zero. The pad 40 is pivotal toward the base 10 from the initial position. At the initial position, the end of the stopper 14 on the base 10 is located in the socket 44 in the rear surface 41A of the pad 40. When the pad 40 is depressed by the driver, the pad 40 and the arm 50, which are located at the initial position, pivot toward the front of the vehicle (left side as viewed in FIG. 4) against the biasing force of the spring 24. The arm 50 pivots about the pivot shaft 22, and the pad 40 pivots about the hinge 30. Thus, the arm 50 and the pad 40 pivot along different lines. Accordingly, when the pad 40 is depressed by the driver, the pad 40 and the arm 50 pivot to upwardly move the insertion portion 51 of the arm 50 in the elongated hole 43 in the longitudinal direction of the pad 40. When the driver applies a larger depressing force and increases the pivot amount of the pad 40 and the arm 50, the arm 50 comes into contact with the vehicle body as shown by the broken lines in FIG. 4. This restricts further pivoting of the arm 50. When the driver releases the pad 40, the biasing force of the spring 24 pivots the arm 50 and the pad 40 toward the rear of the vehicle. When the arm 50 comes into contact with the wall of the box 21 of the housing 20, the arm 50 and the pad 40 stop pivoting. This holds the arm 50 and the pad 40 at the initial position. The rotation angle sensor 23 detects the rotation angle of the pivot shaft 22, which is coupled to the upper end of the arm 50, and provides a vehicle controller (not shown) with a signal corresponding to the rotation angle. The controller, for example, uses the signal received from the rotation angle sensor 23 to obtain the pivot amount of the pad 40, that is, the depression amount of the accelerator pedal, and executes various controls in the vehicle.

Figure 5:
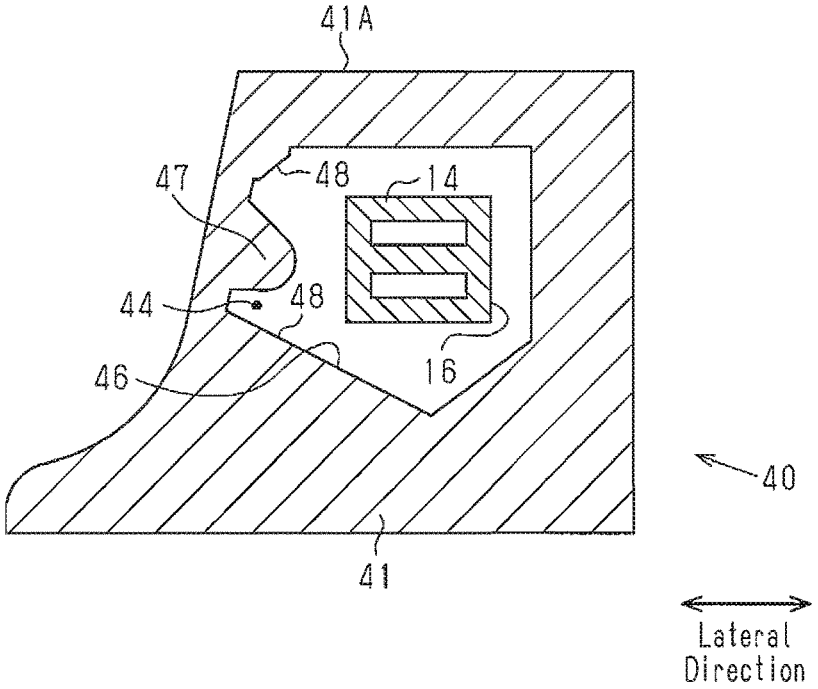
FIG. 5 is a cross-sectional view taken along line 5-5 in FIG. 4.

As described above, the position of the pad 40 where the arm 50 contacts the vehicle body is a position where the pivot amount of the pad 40 is maximal and referred to as the maximum pivot position. As the pad 40 pivots from the initial position to the maximum pivot position, the bottom wall 45 of the socket 44 approaches the end surface 15 of the stopper 14. The projection length of the stopper 14 is set so that the end surface 15 does not contact the bottom wall 45 of the socket 44 even when the pad 40 is located at the maximum pivot position. The stopper 14 and the socket 44 extend in the pivot direction of the pad 40, and the stopper 14 is receivable in the socket 44. As shown in FIG. 5, the peripheral wall 16 of the stopper 14 is opposed to the bulged portion 47 of the socket 44, and the peripheral wall 46 of the socket 44 is spaced apart from the peripheral wall 16 the stopper 14. The bulged portion 47 is located on the peripheral wall 46 of the socket 44 at the vehicle inner side with respect to the lateral direction of the vehicle, that is, the portion of the peripheral wall 46 of the socket 44 located at the left side as viewed in FIG. 5.

The advantages of the present embodiment will now be described with reference to FIG. 6.

Figure 6:
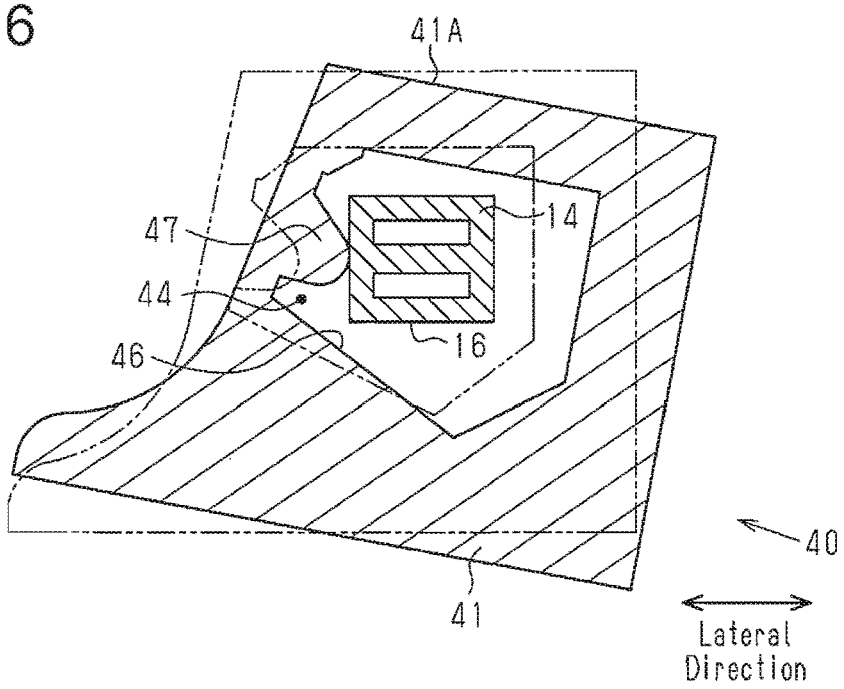
FIG. 6 is a cross-sectional view of the stopper and the pad when the pad is displaced in the lateral direction.

(1) As shown by the broken lines in FIG. 6, when the pad 40 is not depressed, a gap extends between the bulged portion 47 in the socket 44 of the pad 40 and the peripheral wall 16 of the stopper 14. Thus, if load acts on the pad 40 in the lateral direction of the vehicle, that is, the lateral direction of the pad 40, when the pad 40 is being depressed, the pad 40 is displaced relative to the base 10 in the lateral direction of the vehicle. Such a load displaces the upper end of the pad 40 in the lateral direction of the vehicle about the lower end of the pad 40, which is supported by the hinge 30. For example, when a load acts on the pad 40 from the inner side in the lateral direction of the vehicle (left side as viewed in FIG. 6) toward the outer side in the lateral direction of the vehicle (right side as viewed in FIG. 6), the pad 40 is displaced toward the outer side in the lateral direction of the vehicle (right side as viewed in FIG. 6). In this manner, when the pad 40 is displaced in the lateral direction of the pad 40, the bulged portion 47 of the pad 40 contacts the stopper 14 of the base 10. Then, the bulged portion 47 and the stopper 14 cooperate to restrict further displacement of the pad 40. Under such a condition, the load acting in the lateral direction of the vehicle is received by the bulged portion 47 and the stopper 14 in addition to the hinge 30. This reduces the load acting on the hinge 30 and obviates the generation of excessive stress at the hinge 30, which supports the pad 40.

(2) The pad 40 includes the socket 44, which serves as the first restriction portion, and the base 10 includes the stopper 14, which is a projection that is receivable in the socket 44 and serves as the second restriction portion. Thus, load acting on the pad 40 in the lateral direction of the pad 40 is received by the wall surface of the socket 44 and the wall surface of the stopper 14. The portion that receives the load is the socket 44 in the rear surface 41A of the pad 40, and the wall surface of the socket 44 is not exposed to the outside. This limits foreign matter that enters the gap between the socket 44 and the stopper 14.

(3) The socket 44 includes the bulged portion 47. When the pad 40 is displaced in the lateral direction, the bulged portion 47 contacts the peripheral wall 16 of the stopper 14. The bulged portion 47 is shaped so that its cross-sectional area decreases toward the distal end. Thus, the area of contact is small between the bulged portion 47 and the peripheral wall 16 of the stopper 14. This limits foreign matter that becomes held in the gap between the bulged portion 47 and the peripheral wall 16.

(4) When the pad 40 is located at the initial position, the end of the stopper 14 is located in the socket 44. Thus, regardless of the pivot position of the pad 40, the stopper 14 is always located in the socket 44. As a result, when load acts on the pad 40 in the lateral direction, the bulged portion 47 comes into contact with the stopper 14 regardless of the pivot position of the pad 40, and the wall surface of the socket 44 and the wall surface of the stopper 14 receive the load. This further obviates the generation of excessive stress at the hinge 30, which supports the pad 40.

(5) The socket 44 of the pad 40 is located near the lower end of the pad 40, and the stopper 14 is arranged on the base 10 so that the socket 44 receives the stopper 14. The socket 44 and the stopper 14 are located near the longitudinally lower end of the pad 40. Thus, compared to when the socket 44 and the stopper 14 are located near the upper end of the pad 40, the depth of the socket 44 and the length of the stopper 14 can be decreased in the pivot direction of the pad 40. This ensures the rigidity of the pad 40 and the stopper 14, decreases the cross-sectional area of the socket 44 and the stopper 14, and limits foreign matter that enters the gap between the socket 44 and the stopper 14.

(6) The bulged portion 47 projects from the peripheral wall 46 of the socket 44 opposing the stopper 14. This decreases the distance from the peripheral wall 46 of the socket 44 to the stopper 14 compared to when the socket 44 does not include the bulged portion 47. Thus, when load in the lateral direction of the vehicle acts to displace the pad 40, the displacement is restricted at an early stage.

(7) When the driver is driving the vehicle, the user may place his or her heel between the brake pedal and the accelerator pedal or depress the accelerator pedal with the heel placed on the brake pedal. In such a case, the toes of the driver are directed toward the outer side of the vehicle. Thus, when depressing the accelerator pedal, load acts on the pad 40 from the inner side toward the outer side in the lateral direction of the vehicle. In the present embodiment, the bulged portion 47 is located on the peripheral wall 46 of the socket 44 at the inner side in the lateral direction of the vehicle. Thus, although the load is apt to displacing the pad 40 toward the outer side in the lateral direction of the pad 40, displacement of the pad 40 can be restricted. This further obviates the generation of excessive stress at the hinge 30 of the accelerator pedal.

(8) The peripheral wall 46 of the socket 44 and the peripheral wall 16 of the stopper 14 are spaced apart from each other except when restricting displacement of the pad 40 in the lateral direction. This keeps the sliding resistance of the pad 40 low when the pad 40 is depressed. Further, the dimensional tolerance when molding the pad 40 and the base 10 can be increased to improve the coupling efficiency of components.

It should be apparent to those skilled in the art that the present invention may be embodied in many other specific forms without departing from the spirit or scope of the invention. Particularly, it should be understood that the present invention may be embodied in the following forms. The modified examples described below may be combined with one another.

When the pad 40 is located at the initial position, the end of the stopper 14 does not have to be located in the socket 44. In such a case, the projection length of the stopper 14 is set so that the stopper 14 is received in the socket 44 when the pad 40 reaches a certain pivot position.

In the above embodiment, the bulged portion 47 is located in the peripheral wall 46 of the socket 44 at the inner side in the lateral direction of the vehicle (left side as viewed in FIG. 6). However, the location of the bulged portion 47 may be changed. For example, the bulged portion 47 may be located in the peripheral wall 46 of the socket 44 at the outer side in the lateral direction of the vehicle (right side as viewed in FIG. 6). In such a case, when load acts on the pad 40 from the outer side toward the inner side in the lateral direction of the vehicle, the bulged portion 47 comes into contact with the stopper 14.

Figure 7:
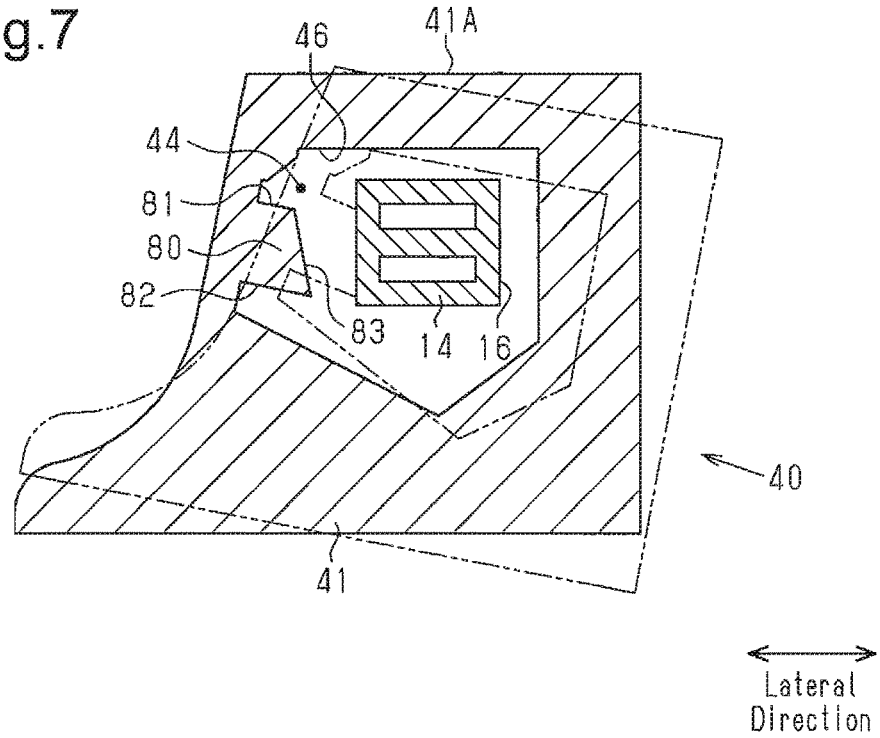
FIG. 7 is a cross-sectional view of a stopper and a pad in another embodiment of the vehicle pedal device.

The bulged portion 47 is not limited to the shape described above. For example, as shown by the solid lines in FIG. 7, a bulged portion 80 may have a trapezoidal cross section and include an upper wall 81 and a lower wall 82, which are parallel to each other, and an end wall 83, which extends between the upper wall 81 and the lower wall 82. The lower wall 82 extends from the peripheral wall 46 over a longer length than the upper wall 81, and the end wall 83 is inclined so as to be farther from the peripheral wall 46 as the lower wall 82 becomes closer. In such a structure, when the pad 40 receives load that acts in the lateral direction of the vehicle, the pad 40 is displaced in the lateral direction and the bulged portion 80 contacts the stopper 14 as shown by the broken lines in FIG. 7. Since the end wall 83 is inclined as described above, when or after the bulged portion 80 contact the stopper 14, the end wall 83 of the bulged portion 80 easily comes into planar contact with the peripheral wall 16 of the stopper 14. Such a structure also restricts displacement of the pad 40 and reduces the load that acts on the hinge 30.

The bulged portion 47 may be provided in a non-continuous manner in the socket 44 from the open end to the bottom wall 45. Further, the bulged portion 47 may be arranged in only part of the socket 44 between the open end and the bottom wall 45.

In the above embodiment, the peripheral wall 46 the socket 44 includes only one bulged portion 47. However, the peripheral wall 46 may includes a plurality of bulged portions. Alternatively, the socket 44 may be less the bulged portion 47.

Instead of providing a bulged portion on the peripheral wall 46 of the socket 44, the peripheral wall 16 of the stopper 14 may be provided with the bulged portion. In such a case, the structure of FIG. 8 may be employed.

Figure 8:
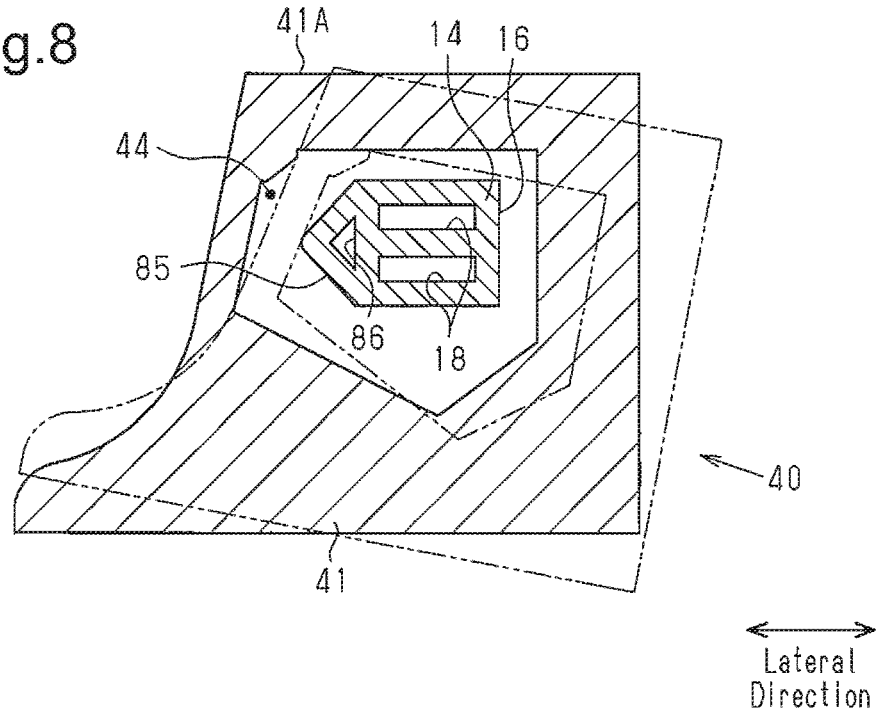
FIG. 8 is a cross-sectional view of a stopper and a pad in a further embodiment of the vehicle pedal device.

As shown by the solid lines in FIG. 8, the peripheral wall 16 of the stopper 14 includes a portion at one end in the lateral direction of the pad 40 (left portion in FIG. 8) that defines a bulged portion 85, which is bulged from the peripheral wall 16. The bulged portion 85 is tapered so that the cross-sectional area decreases toward the distal end. In the same manner as the cavities 18, the bulged portion 85 includes a cavity 86 that opens in the end surface 15 of the main body 17. In such a structure, as shown by the broken lines in FIG. 8, when the pad 40 is displaced in the lateral direction of the pad 40, the bulged portion 85 of the stopper 14 contacts the peripheral wall 46 of the socket 44. The socket 44 and the bulged portion 85 cooperate to restrict displacement of the pad 40.

The stopper 14 does not have to include the cavities 18 and 86.

Figure 9:
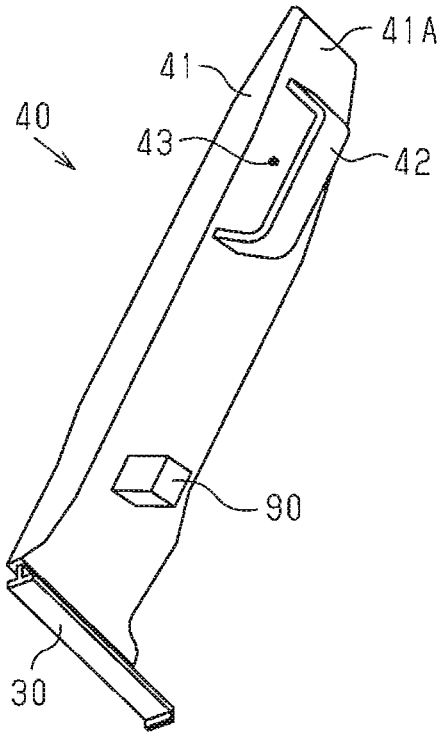
FIG. 9 is a perspective view showing the rear surface of the pad in a further embodiment of the vehicle pedal device.
Figure 10:
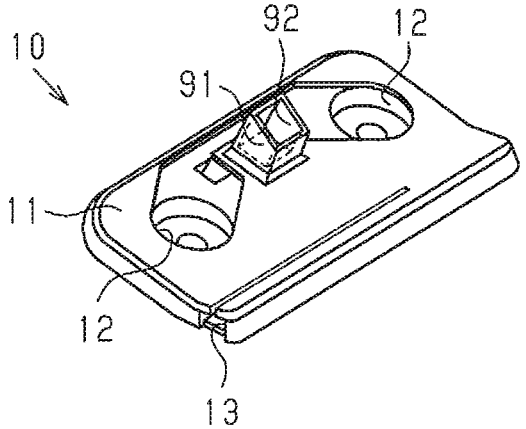
FIG. 10 is a perspective view of a base coupled to the pad shown in FIG. 9.

The pad 40 may include a stopper in the form of a projection and functioning as the first restriction portion, and the base 10 may include a socket that receives the stopper. FIGS. 9 and 10 show an example of such a structure.

As shown in FIG. 9, a tetragonal stopper 90 projects from the rear surface 41A of the pad 40. As shown in FIG. 10, the base 10 includes a box-shaped receptacle 91 upwardly extending from the upper surface of the support plate 11. The stopper 90 is receivable in the interior 92 of the receptacle 91. That is, the receptacle 91 of the base 10 functions as a socket (recess) that is capable of accommodating the stopper 90. In such a structure, when the pad 40 is coupled to the base 10, the stopper 90 on the rear surface 41A of the pad 40 can be received in the interior 92 of the receptacle 91. When the pad 40 is displaced in the lateral direction, the stopper 90 contacts the inner wall surface of the receptacle 91. This restricts displacement of the pad 40 and reduces the load acting on the hinge 30.

The first restriction portion and the second restriction portion may both be configured by stoppers defined by projections. For example, the structure shown in FIGS. 11 and 12 may be employed as such a structure.

Figure 11:
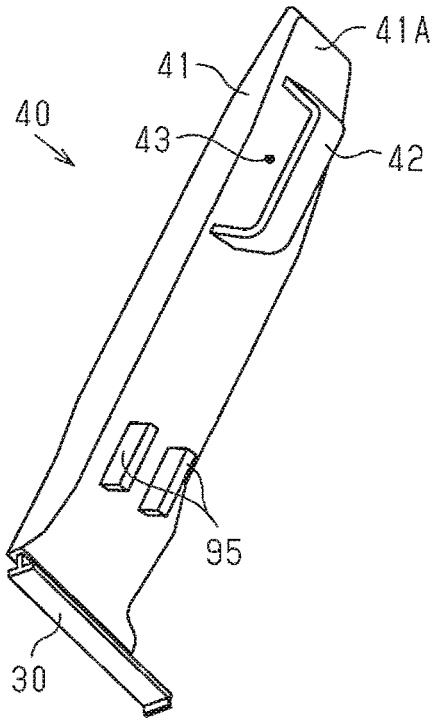
FIG. 11 is a perspective view showing the rear surface of the pad in a further embodiment of the vehicle pedal device.
Figure 12:
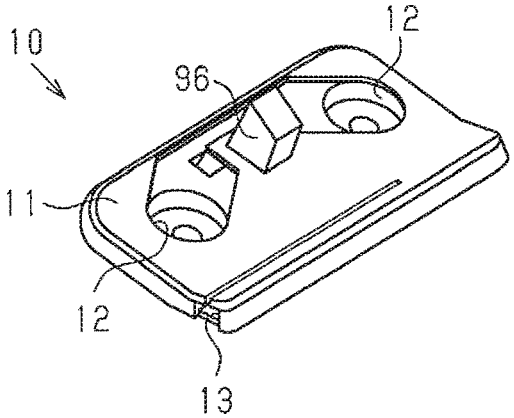
FIG. 12 is a perspective view of a base coupled to the pad shown in FIG. 11.

As shown in FIG. 11, the pad 40 includes two first stoppers 95 that serve as a first restriction portion. The first stoppers 95 extend from the rear surface 41A and are separated from each other in the lateral direction by a predetermined distance. The first stoppers 95 define a recess therebetween. As shown in FIG. 12, the base 10 includes a second stopper 96, which serve as a second restriction portion and upwardly extends from the upper surface of the support plate 11. The distance between the two first stoppers 95 is set to allow the second stopper 96 to be received between the first stoppers 95. In such a structure, when the pad 40 is coupled to the base 10, the second stopper 96 is arranged between the first stoppers 95, and the side surfaces of the second stopper 96 are opposed to the side surfaces of the first stoppers 95 in the lateral direction. Thus, if the pad 40 is displaced in the lateral direction when the pad 40 is coupled to the base 10, the second stopper 96 comes into contact with one of the first stoppers 95. This reduces the load acting on the hinge 30 and restricts displacement of the pad 40.

In the above embodiment, the peripheral wall 46 the socket 44 is separated from the peripheral wall 16 of the stopper 14. Instead, for example, the peripheral wall 46 of the socket 44 at one side in the lateral direction of the pad 40 may constantly be in contact with the opposing side of the stopper 14. Alternatively, two sides of the peripheral wall 46 of the socket 44 in the lateral direction of the Dad 40 may constantly be in contact with the two opposing sides of the stopper 14.

The stopper 14 does not have to be shaped as described above. For example, the stopper 14 may have a polygonal shape other than a tetragonal shape. Alternatively, the stopper 14 may be cylindrical.

The socket 44 does not have to be located near the lower longitudinal end of the pad 40 and may be located, for example, near the upper longitudinal end.

A support unit that differs from the base 10 and the housing 20 may be fixed to the vehicle body, and the support unit may include the second restriction portion, such as a stopper or a socket.

The shape of the holding portion 42 may be changed. For example, a holding portion may have the form of a semi-cylindrical tube extending in the lateral direction of the pad 40 and have a semicircular cross section. Alternatively, a holding portion may have the form of a polygonal tube and have a polygonal cross section.

The holding portion 42 may be omitted. In this case, for example, a side surface of the depressing plate 41 of the pad 40 may include a holding hole. In this case, the holding hole only needs to extend for a predetermined length in the longitudinal direction to allow for movement of the arm 50.

The pivoting range of the pad 40 toward the front of the vehicle is restricted when the arm 50 comes into contact with the vehicle body. However, the pivot range of the pad 40 may be restricted by a different structure. For example, the pivot range of the pad 40 may be restricted by contact of the upper end of the arm 50 with the wall surface of the box 21 of the housing 20. Alternatively, the pivot range of the arm 50 may be restricted by contact of the end surface 15 of the stopper 14 with the bottom wall 45 of the socket 44. As another option, the pivot range of the arm 50 may be restricted by contact of the end surface 15 of the stopper 14 with the rear surface 41A of the pad 40 or the upper surface of the support plate 11.

The spring 24, which is arranged in the housing 20, biases the arm 50 and the pad 40 toward the rear of the vehicle. Instead, for example, a spring may be arranged between the vehicle body and the arm 50. Alternatively, a spring may be used to bias the pivot shaft 22 in the counterclockwise direction. Further, an elastic member other a spring may be used.

The vehicle pedal device is not limited to an accelerator pedal. For example, a similar structure may be applied to a brake pedal.

The present examples and embodiments are to be considered as illustrative and not restrictive, and the disclosure is not to be limited to the details given herein.

The invention claimed is:

1. A vehicle pedal device comprising:

a support unit fixed to a vehicle body;

a hinge supported by the support unit;

a pad having the form of a rectangular plate, wherein the pad includes a lower longitudinal end pivotally supported by the hinge; and an arm that is supported by the support unit and follows pivoting of the pad, wherein the pad includes a first restriction portion, the support unit includes a second restriction portion, the first restriction portion and the second restriction portion cooperate with each other to restrict displacement of the pad in a lateral direction of the pad, one of the first restriction portion and the second restriction portion is a socket that extends in a pivot direction of the pad, the other one of the first restriction portion and the second restriction portion is a stopper that extends in the pivot direction, has the form of a projection, and is configured to be receivable in the socket, one of the socket and the stopper includes a peripheral wall including a bulged portion bulged from the peripheral wall, and the bulged portion extends in the lateral direction of the pad from the peripheral wall.

2. The vehicle pedal device according to claim 1, wherein the bulged portion is shaped so that the bulged portion decreases in cross-sectional area toward a distal end of the bulged portion.

3. The vehicle pedal device according to claim 1, wherein the pad is configured to pivot from an initial position toward the support unit about a pivot axis that extends in the lateral direction of the pad, and the stopper includes an end located in the socket when the pad is located at the initial position.

4. A vehicle pedal device comprising:

a support unit fixed to the vehicle body;

a hinge supported by the support unit;

a pad having the form of a rectangular plate, wherein the pad includes a lower longitudinal end pivotally supported by the hinge; and an arm that is supported by the support unit and follows pivoting of the pad, wherein one of the pad and the support unit includes a stopper that extends toward the other one of the pad and the support unit, the other one of the pad and the support unit includes a recess configured to receive the stopper, one of the recess and the stopper includes a peripheral wall including a bulged portion extending from the peripheral wall in a lateral direction of the pad.

5. The vehicle pedal device according to claim 4, wherein the bulged portion is shaped so that the bulged portion decreases in cross-sectional area toward a distal end of the bulged portion.

6. The vehicle pedal device according to claim 4, wherein the pad is configured to pivot from an initial position toward the support unit about a pivot axis extending in a lateral direction of the pad, and the stopper includes an end located in the recess when the pad is located at the initial position.

7. A vehicle pedal device comprising:

a support unit fixed to the vehicle body;

a hinge supported by the support unit;

a pad having the form of a rectangular plate, wherein the pad includes a lower longitudinal end pivotally supported by the hinge; and an arm that is supported by the support unit and follows pivoting of the pad, wherein one of the pad and the support unit includes a stopper that extends toward the other one of the pad and the support unit, the other one of the pad and the support unit includes a recess configured to receive the stopper, the recess and the stopper include facing walls that face each other in a lateral direction of the pad when the stopper is received in the recess, and one of the facing walls includes a bulged portion bulged toward the other one of the facing walls.

* * * * *